United States Patent [19]

Kimura et al.

[11] 4,120,456

[45] Oct. 17, 1978

[54] FUEL INJECTION VALVE WITH VORTEX CHAMBER OCCUPYING AUXILIARY VALVE

[75] Inventors: Takeo Kimura; Hitoshi Tomita, both of Higashimatsuyama, Japan

[73] Assignee: Diesel Kiki Co., Ltd., Tokyo, Japan

[21] Appl. No.: 747,147

[22] Filed: Dec. 3, 1976

[30] Foreign Application Priority Data

Jan. 28, 1976 [JP] Japan ..... 51-8434[U]

[51] Int. Cl.[2] ..... B05B 1/30; B05B 1/34

[52] U.S. Cl. ..... 239/464; 239/473; 239/533.12

[58] Field of Search ..... 239/463, 464, 468, 471, 239/472, 473, 491–493, 533.1–533.12

[56] References Cited

U.S. PATENT DOCUMENTS

| | | | |
|---|---|---|---|
| 1,322,137 | 11/1919 | Salfeld | 239/493 X |
| 1,333,612 | 3/1920 | Fisher | 239/493 X |
| 1,607,805 | 11/1926 | Sprado | 239/464 |
| 2,414,544 | 1/1947 | Moore | 239/464 |
| 2,613,998 | 10/1952 | Noon et al. | 239/464 |

FOREIGN PATENT DOCUMENTS

| | | | |
|---|---|---|---|
| 505,298 | 12/1954 | Italy | 239/533.3 |
| 8,008 of | 1913 | | |

*Primary Examiner*—Evon C. Blunk
*Assistant Examiner*—Andres Kashnikow
*Attorney, Agent, or Firm*—Sughrue, Rothwell, Mion, Zinn and Macpeak

[57] ABSTRACT

The vortex chamber (11) of a fuel injection valve is occupied by a stepped, spring biased auxiliary valve (13) disposed in a cylindrical recess (8a) in a passage member (7) at the completion of each injection cycle. This seals the nozzle opening (14) and expels any residual fuel from the vortex chamber in preparation for the next injection cycle. The auxiliary valve (13) is raised by the injection pressure acting on its downwardly facing, circular shoulder. Alternatively, the auxiliary valve may be made integral with the main needle valve (29) in the form of a truncated conical tip (27a) on the end of an axial stem portion (27), the tip extending through and occupying a vortex chamber above a valve seat (26) at the end of each injection cycle.

2 Claims, 6 Drawing Figures

FUEL INJECTION VALVE WITH VORTEX CHAMBER OCCUPYING AUXILIARY VALVE

BACKGROUND OF THE INVENTION

1. Field of the Invention

This invention relates to a fuel injection valve for an internal combustion engine, and more particularly to a vortex nozzle for use in a fuel injection valve for shortening the injection distance without hindering the atomization of the fuel.

2. Description of the Prior Art

The prior art teaches both inwardly and outwardly opening, vortex type fuel injection valves for gasoline, Diesel and other types of internal combustion engines. Such valves suffer from the disadvantage, however, that some fuel remains in the space between the needle valve seat and its injection opening after the completion of each injection cycle, and such residual fuel hinders the swirling flow of fuel in the subsequent injection cycle. Thus, the fuel is not completely atomized, but instead is injected in a liquid form with a large force to impinge on and cling to the walls of the combustion chamber. This in turn prevents or retards the complete combustion of the fuel. In addition, when a vortex chamber is provided above the valve seat, as disclosed in Japanese Patent Publication 6556/1951 and Japanese Utility Model Publication 9705/1956, large size droplets or particles of fuel are produced in the initial stages of injection. On the other hand, if the distance between the vortex chamber and the valve seat is increased, then a large resistance loss occurs, which inhibits the desired fuel swirling effect and results in excessive exhaust gas pollutants.

SUMMARY OF THE INVENTION

It is therefore an object of the present invention to eliminate the above mentioned drawbacks of conventional fuel injection valves by providing means for enabling a swirling flow of fuel from the initial stage of injection.

Specifically, a fuel injection valve according to the present invention includes an auxiliary valve which eliminates the space for residual fuel within the votex chamber during the closure of the needle valve, shortens the fuel injection distance, and achieves a more satisfactory atomization of the fuel. The auxiliary valve closes the path of the fuel into the injection opening after the completion of each fuel injection cycle. The auxiliary valve may be integral with the conventional needle valve, and occupies the vortex chamber when the needle valve is closed. This enables the distance between the vortex passage and the valve seat to be shortened, which increases the atomization of the fuel, shortens the overall fuel injection distance, and thereby helps to reduce the amount of exhaust gas pollutants.

DETAILED DESCRIPTION OF THE PREFERRED EMBODIMENTS

Figure 1:
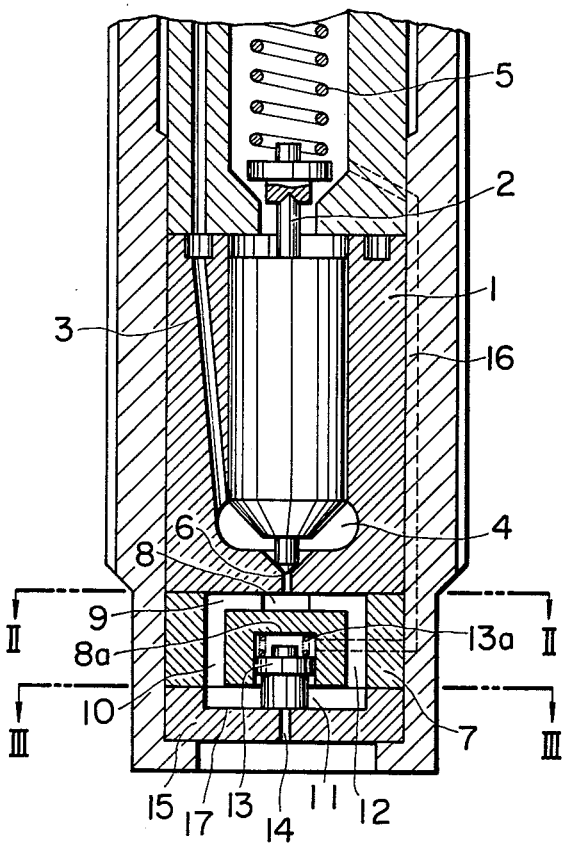
FIG. 1 is a vertical sectional view showing one embodiment of the present invention.
Figure 2:
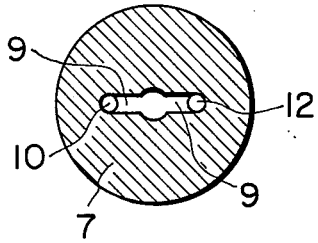
FIG. 2 is a transverse, sectional view of the embodiment of FIG. 1, taken along the line II—II, showing the upstream face of the passage member of the fuel injection valve.
Figure 3:
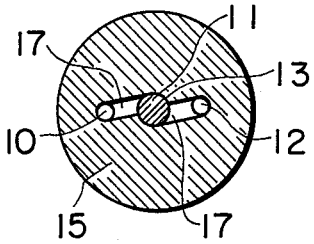
FIG. 3 is a further transverse, sectional view of the fuel injection valve of FIG. 1, taken along the line III—III, showing the downstream face of the passage member.

A first embodiment of the invention will now be described in detail with reference to FIGS. 1 to 3, wherein a cylindrical valve body 1 houses a needle valve 2, a fuel delivery passage 3, and a fuel reservoir 4. The needle valve 2 is urged against a valve seat 6 in the valve body 1 by a coil spring 5. As best shown in FIG. 2, downstream of the needle valve 2 is a passage member 7 defining a circular recess 8 concentric with the needle valve, fuel passages 9 extending radially of the circular recess 8, and diametrically opposite, axial fuel passages 10, 12 communicating the passages 9 with the opposite, lower face of the passage member 7. An axially aligned, cylindrical recess 8*a* is provided in the lower face of the passage member, and disposed in said recess is a stepped, piston like auxiliary valve 13 urged downwardly by a spring 13*a*. A nozzle member 15 has a nozzle opening 14 extending therethrough, and defines in its upper face a vortex chamber 11 just below the recess 8*a*, and tangential passages 17 communicating the fuel passages 10, 12 with the vortex chamber. The spring 13*a* biases the auxiliary valve 13 down into the chamber 11 to close off the nozzle opening 14, and expell any residual fuel from the chamber after the completion of each fuel injection cycle. The valve 13 is raised, against the force of the spring 13*a*, by injection pressure acting on its stepped, circular shoulder. Any fuel that seeps into the recess 8*a* may escape or be vented through a low pressure leak passage 16 into the upper portion of the valve body 1.

In operation, the pressure in the fuel delivery passage 3 and the reservoir 4 is cyclically increased by a fuel injection pump, not shown, in a well known manner, thereby raising the needle valve 2 against the force of the spring 5. Fuel is thus delivered from the reservoir 4 into the circular recess 8, then through the passages 9, 10 and 12, and 17 to the stepped shoulder of the auxiliary valve 13. This (pressure) raises the latter into the recess 8*a*, to open the vortex chamber 11 and the nozzle opening 14. Fuel then swirls within the vortex chamber and is injected through the nozzle opening 14 into the combustion chamber of the engine cylinder. After the completion of the injection cycle, the pressure is dropped and both the auxiliary valve 13 and the needle valve 2 are lowered, thereby occupying the vortex chamber and closing the nozzle opening 14.

Figure 4:
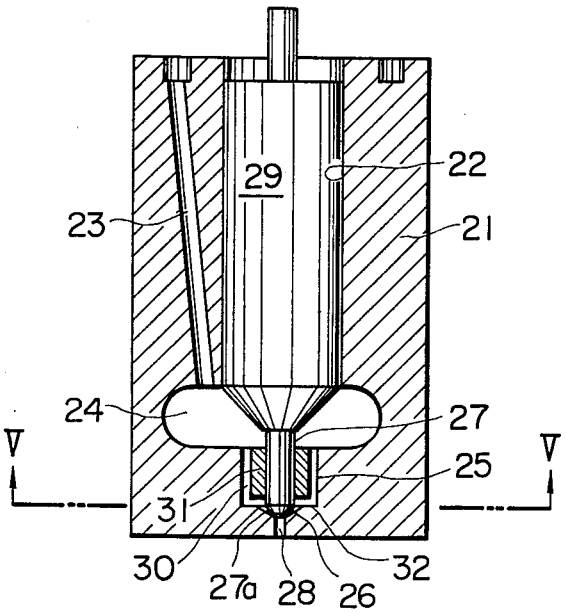
FIG. 4 is a vertical sectional view showing another embodiment of the present invention.
Figure 5:
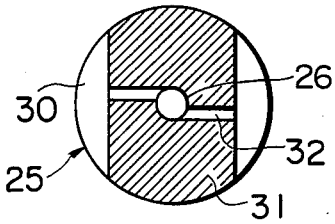
FIG. 5 is a transverse, sectional view of the embodiment of FIG. 4, taken along the line V—V.
Figure 6:
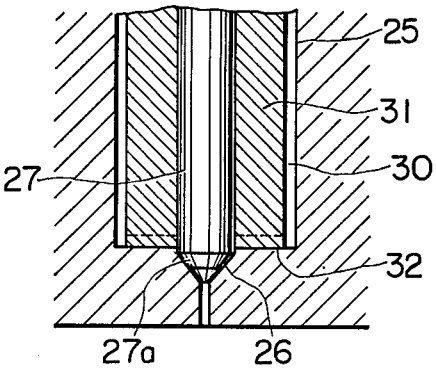
FIG. 6 is an enlarged sectional view showing a lower portion of FIG. 4.

In a second embodiment of the invention shown in FIGS. 4 to 6, a valve body 21 houses or defines a needle valve bore 22, a fuel delivery passage 23, a fuel reservoir 24, a circular bore 25 below the reservoir, a valve seat 26, and an injection opening 28. A needle valve 29 disposed in the bore 22 has an axial stem portion 27 of relatively small diameter provided with a conical tip 27*a* adapted to enter and seat within the valve seat 26. As shown in FIG. 5, a guide piece 31 having flattened opposite sides is press-fitted in the circular bore 25, and defines therewith fuel passages 30. The stem portion 27 extends through a central bore in the guide piece 31, and defined in the lower face of the guide piece are tangential fuel passages 32 communicating the passages 30 with the valve seat 26.

In operation, the fuel pressure in the delivery passage 23 and reservoir 24 is increased during an injection cycle by a fuel injection pump, not shown, thereby raising the needle valve 29 against a force of a spring, also not shown, whereby fuel is fed from the reservoir 24 through the passages 30, 32 into the valve seat 26, followed by spiralling injection through the nozzle opening 28.

Upon the closing of the valve at the completion of the injection cycle, the conical tip 27*a* of the stem portion 27 enters the valve seat 26. This eliminates or expells any residual fuel in the valve seat area in preparation for the subsequent injection cycle. The vortex chamber in this embodiment is defined by the portion of the central bore in the guide piece 31 just above the valve seat 26, i.e. the lower portion of the bore unoccupied by the tip 27*a* when the needle valve 29 is in its raised position.

What is claimed is:

1. In a fuel injection valve for an internal combustion engine including a valve body having a central bore therein, a circular main valve seat within the valve body, a fuel reservoir within the valve body adjacent to and surrounding the main valve seat, and an inwardly opening needle valve slidably disposed in said bore and having a tip portion adapted to enter and engage the main valve seat to isolate the fuel reservoir therefrom, the improvements characterized by:

(a) a fuel injection opening in the lower end of the valve body defining an auxiliary valve seat at its upper end, (b) a vortex chamber defined in the valve body just above the fuel injection opening, (c) fuel delivery passages having inlet ends communicating with the circular main valve seat to receive fuel flowing past said needle valve when open, and outlet ends tangentially communicating with the vortex chamber, and (d) an auxiliary valve disposed above the vortex chamber for entering and occupying said chamber in response to a reduction in pressure in said vortex chamber at the completion of each injection cycle and for engaging the auxiliary valve seat to close the fuel injection opening, thereby expelling substantially all residual fuel from the vortex chamber in preparation for the next injection cycle.

2. A fuel injection valve as defined in claim 1, wherein the auxiliary valve is disposed in a cylindrical recess in the valve body and is spring biased out of said recess and toward said vortex chamber, and wherein the auxiliary valve has a pressure acting surface whereby it is opened by fuel injection pressure against said spring biasing force.

* * * * *